US008109362B2

(12) United States Patent
Agrawal et al.

(10) Patent No.: US 8,109,362 B2
(45) Date of Patent: Feb. 7, 2012

(54) PASSIVE NOISE ATTENUATION SYSTEM

(75) Inventors: Ajay K. Agrawal, Tuscaloosa, AL (US); Sadasivuni Vijaykant, Greer, SC (US)

(73) Assignee: The Board of Trustees of The University of Alabama, Tuscaloosa, AL (US)

( * ) Notice: Subject to any disclaimer, the term of this patent is extended or adjusted under 35 U.S.C. 154(b) by 38 days.

(21) Appl. No.: 12/468,686

(22) Filed: May 19, 2009

(65) Prior Publication Data

US 2010/0059311 A1 Mar. 11, 2010

Related U.S. Application Data

(60) Provisional application No. 61/054,359, filed on May 19, 2008, now abandoned, provisional application No. 61/058,812, filed on Jun. 4, 2008.

(51) Int. Cl.

| | |
|---|---|
| ***F01N 1/24*** | (2006.01) |
| ***F02B 19/00*** | (2006.01) |
| ***F02B 19/16*** | (2006.01) |
| ***F02B 19/18*** | (2006.01) |
| ***F02B 27/00*** | (2006.01) |
| ***F02B 51/02*** | (2006.01) |
| ***F02B 77/13*** | (2006.01) |
| ***F16F 7/00*** | (2006.01) |
| ***F23D 3/40*** | (2006.01) |

(52) U.S. Cl. ..... 181/256; 123/256; 123/268; 123/272; 123/281; 123/285; 123/286; 123/293; 123/660; 181/204; 181/207; 431/326

(58) Field of Classification Search ..... 181/256, 181/204, 207; 123/272, 660
See application file for complete search history.

(56) References Cited

U.S. PATENT DOCUMENTS

| | | | | |
|---|---|---|---|---|
| 2,573,536 | A * | 10/1951 | Bodine, Jr. | 123/265 |
| 2,853,060 | A * | 9/1958 | Hockel | 123/259 |
| 3,481,317 | A * | 12/1969 | Hughes et al. | 123/143 R |
| 3,840,326 | A * | 10/1974 | Schreter | 431/114 |
| 4,114,567 | A * | 9/1978 | Burton | 123/252 |
| 4,393,830 | A * | 7/1983 | Bodine | 123/272 |
| 4,559,911 | A * | 12/1985 | Bodine | 123/271 |
| 5,307,772 | A * | 5/1994 | Rao et al. | 123/272 |
| 5,596,979 | A * | 1/1997 | Sobotka et al. | 126/91 A |
| 6,151,887 | A * | 11/2000 | Haidn et al. | 60/257 |
| 6,378,291 | B1 * | 4/2002 | Schneider | 60/218 |
| 7,208,136 | B2 * | 4/2007 | Holladay et al. | 423/652 |
| 7,381,230 | B2 * | 6/2008 | Rapier et al. | 48/61 |

(Continued)

OTHER PUBLICATIONS

Cohen et al., "Active Control of Combustion Instability in a Liquid-Fueled Low-NOx Combustor," *Journal of Engineering for Gas Turbines and Power*, 221:281-284 (1999).

(Continued)

*Primary Examiner* — Elvin G Enad
*Assistant Examiner* — Christina Russell
(74) *Attorney, Agent, or Firm* — McKeon, Meunier, Carlin & Curfman, LLC

(57) ABSTRACT

A passive noise attenuation device and system is provided having a reticulated open-cell porous structure configured to acts as a passive control device in order to mitigate combustion noise and instability problems in combustion systems. A porous inert media structure is placed downstream of the reaction zone of a combustion chamber to dissipate noise and/or instability generated upstream in the flame. The porous inert media also limits and/or disintegrates vortical structures in the flame to produce a homogeneous flow field to facilitate distributed reaction zones.

17 Claims, 15 Drawing Sheets

Configuration A1

U.S. PATENT DOCUMENTS

| | | | | |
|---|---|---|---|---|
| 7,666,367 | B1 * | 2/2010 | Durst et al. | 422/220 |
| 2002/0134706 | A1 * | 9/2002 | Keller et al. | 208/250 |
| 2004/0033455 | A1 * | 2/2004 | Tonkovich et al. | 431/7 |
| 2004/0053182 | A1 * | 3/2004 | Yoshida et al. | 431/352 |
| 2004/0262077 | A1 * | 12/2004 | Huff et al. | 181/250 |
| 2006/0096282 | A1 * | 5/2006 | Friedrich et al. | 60/299 |
| 2006/0112636 | A1 * | 6/2006 | Chellappa et al. | 48/61 |
| 2007/0063495 | A1 * | 3/2007 | Saito et al. | 280/736 |
| 2007/0133921 | A1 * | 6/2007 | Haffner et al. | 385/12 |
| 2009/0126592 | A1 * | 5/2009 | Mukunoki et al. | 102/202.7 |

OTHER PUBLICATIONS

Muruganandam et al., "Active Control of Lean Blowout for Turbine Engine Combustors," *Journal of Propulsion and Power*, 21(5):807-814 (2005).

Zinn et al., "Combustion Instabilities in Gas turbine Engines," *Progress in AIAA*, 210:3-26 (2005).

* cited by examiner

Configuration A3

Configuration A2

Configuration A1

PASSIVE NOISE ATTENUATION SYSTEM

This application claims priority to and the benefit of U.S. Provisional Application No. 61/054,359, filed on May 19, 2008, and U.S. Provisional Application No. 61/058,812 filed on Jun. 4, 2008, both of which are incorporated in their entirety in this document by reference.

FIELD OF THE INVENTION

The field of this invention relates generally to noise attenuation and more particularly to passive noise attenuation at the source in combustion systems.

BACKGROUND OF THE INVENTION

In recent years, significant efforts to suppress combustion noise and instabilities have been reported in the context of lean premixed gas turbine combustion systems. The effectiveness of an active combustion control system depends upon actuation, sensing, and control algorithms, among other factors. In spite of the significant progress in these areas, complete reliability of active combustion control in turbine engines is still a major concern, since an unexpected event can destroy the engine within a fraction of a second. Thus, passive techniques that do not affect the system volume or weight are desired to mitigate combustion instabilities and associated noise problems in turbine engines.

In view of the preceding, there is a need for a passive technique to suppress and/or mitigate combustion noise and/or stability.

SUMMARY

The invention relates to a passive noise attenuation system and device to suppress combustion noise in a conventional combustion system. A conventional combustion system, such as, for example and without limitation, a gas turbine can comprise a combustion chamber and an injector assembly In one aspect, the passive noise attenuation device can have a reticulated open-cell porous structure configured to act as a passive control device to mitigate combustion noise and instability problems in turbine engines. In this aspect, the porous structure can be placed downstream of a reaction zone of the combustion system and can dissipate noise and/or instability generated upstream in the flame. In another aspect, the porous structure can be placed in the reaction zone of the combustion system. In this aspect, the vortex shedding mechanism of combustion noise and/or instability can be curtailed on source by inserting the porous structure in the reaction zone to constrain recirculation and/or high turbulence intensity regions. In a further aspect, the porous structure can limit and/or disintegrate vortical structures in the flame to produce a homogeneous flow field to facilitate distributed reaction zones. Optionally, combustion sustained within the porous insert can also provide the ignition energy needed to stabilize the flame.

DETAILED DESCRIPTION OF THE FIGURES

These and other features of the preferred embodiments of the invention will become more apparent in the detailed description in which reference is made to the appended drawings wherein.

Figure 5:
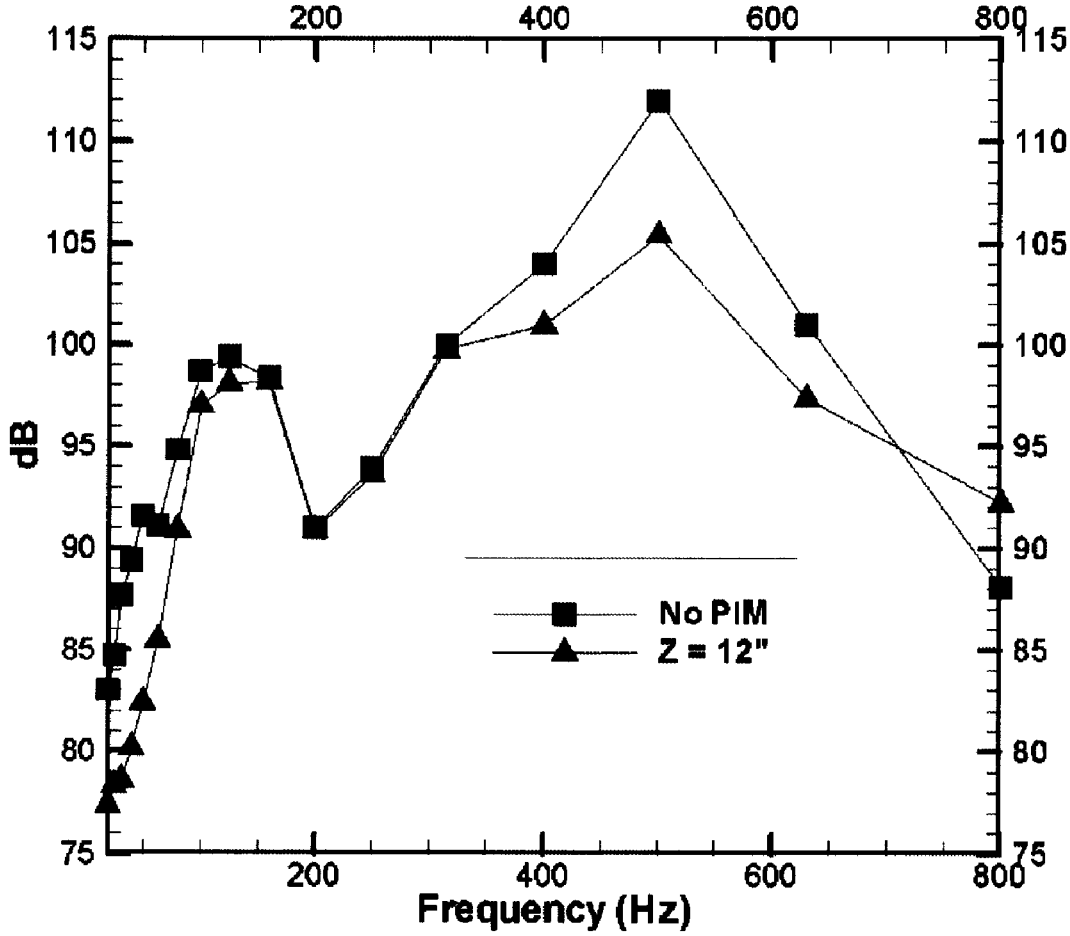

FIG. 5 is a graph showing variation of dB level in octave frequency bands, according to one aspect (Φ=0.65; Total dB with no PIM=114; Total dB with 20 ppi PIM at exit=109).

Figure 6A:
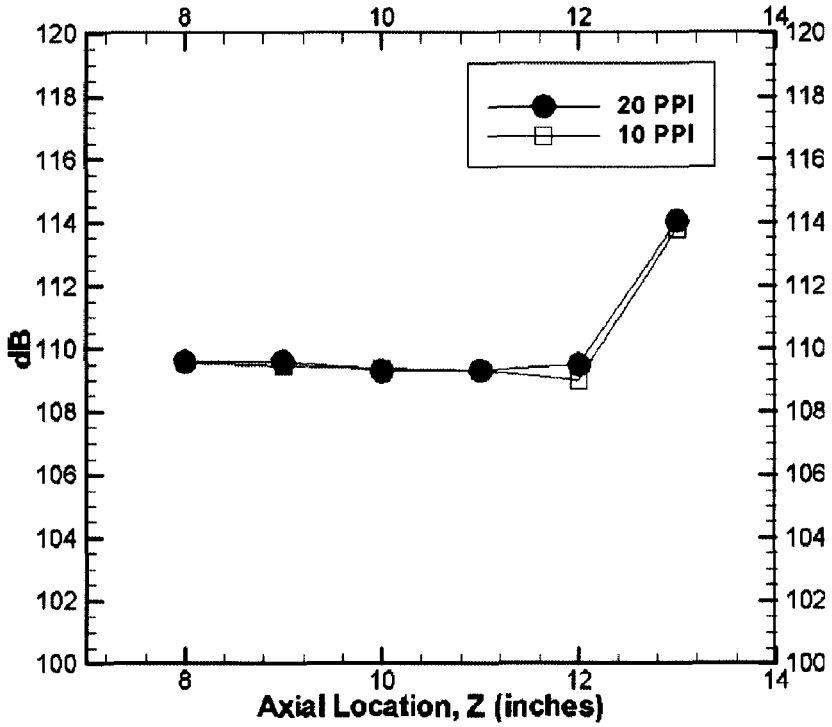
Figure 6B:
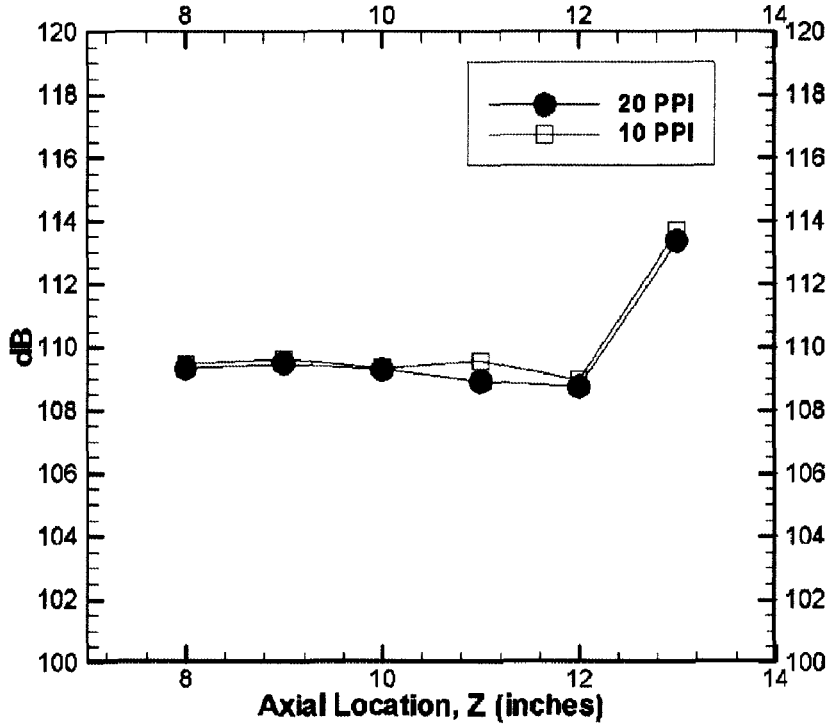

FIGS. 6A and 6B are graphical data showing the effect of pore size on total sound power using a 1" thick and a 3" thick porous inert media, according to one aspect.

Figure 7A:
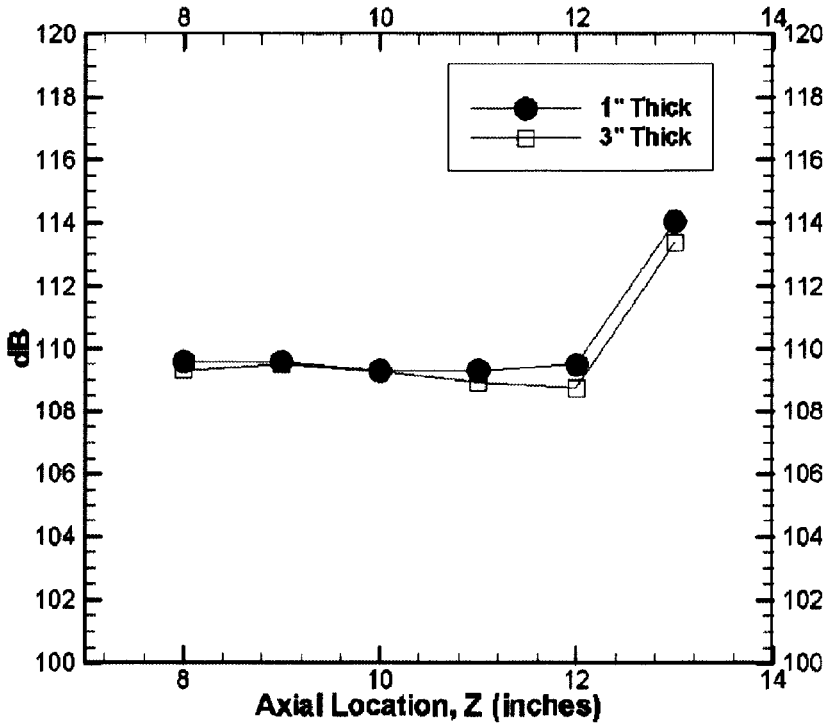
Figure 7B:
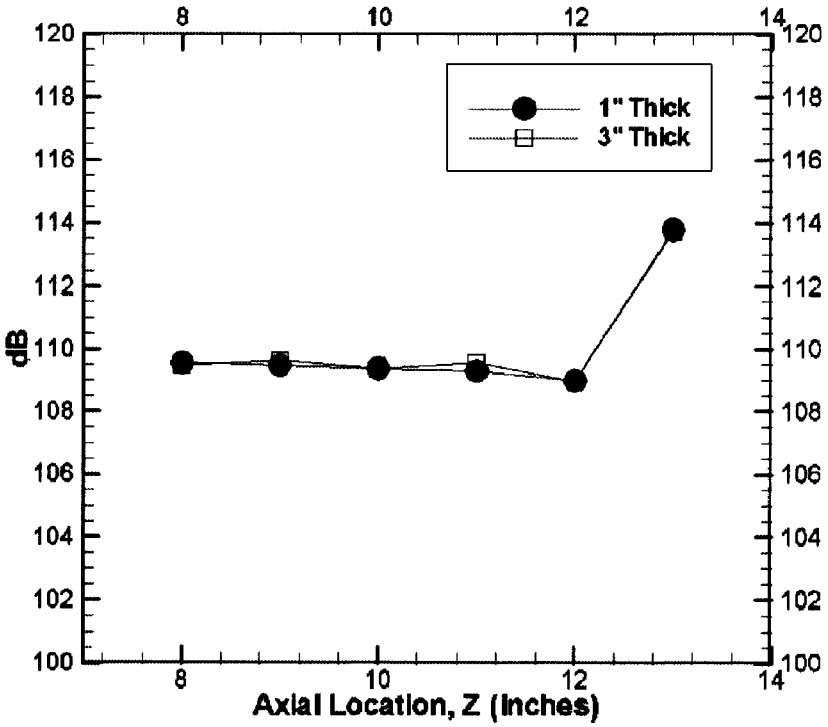

FIGS. 7A and 7B are graphical data showing the effect of thickness on total sound power using a 20 ppi and a 10 ppi porous inert media, according to one aspect.

Figure 8:
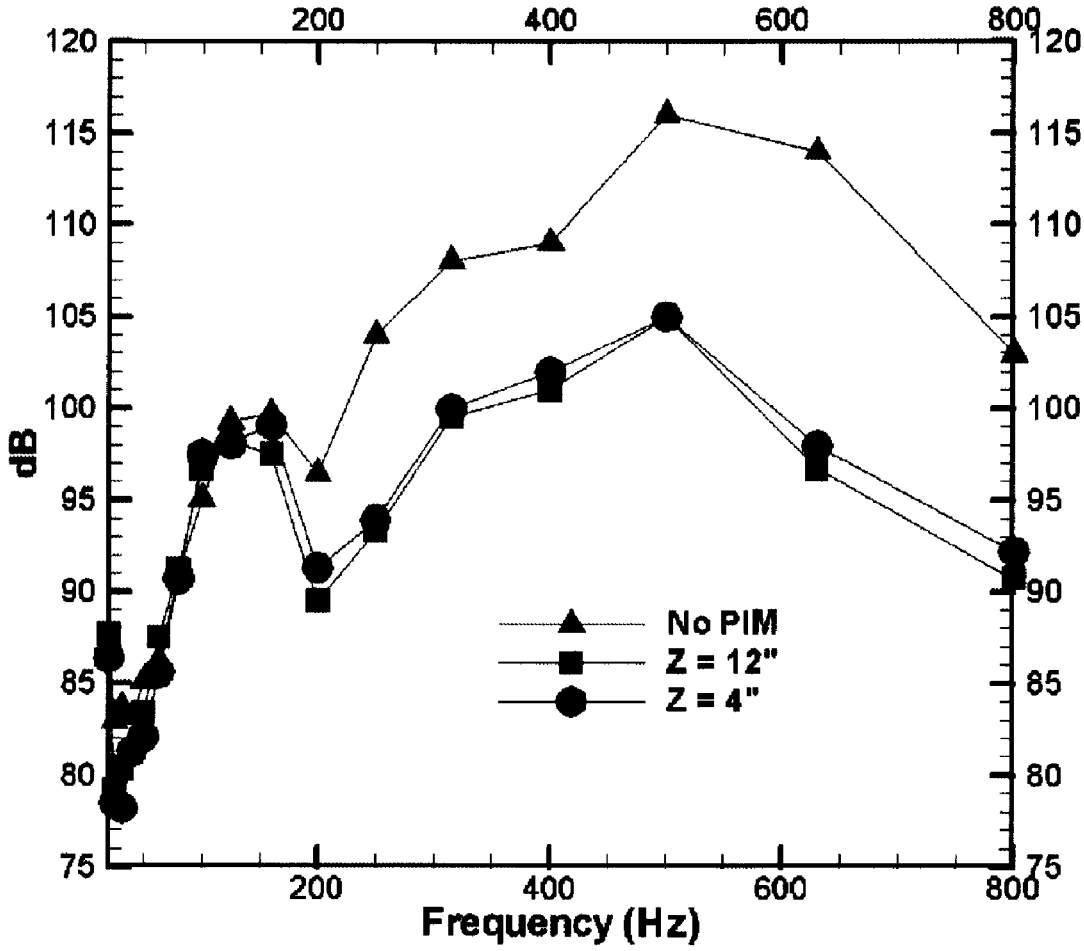

FIG. 8 is a graph showing the variation of dB level in octave frequency bands, according to one aspect (Φ=0.8; Total dB with no PIM=119; Total dB with 10 ppi PIM at exit=109; Total dB with 10 ppi PIM at Z=4"=110).

Figure 9C:
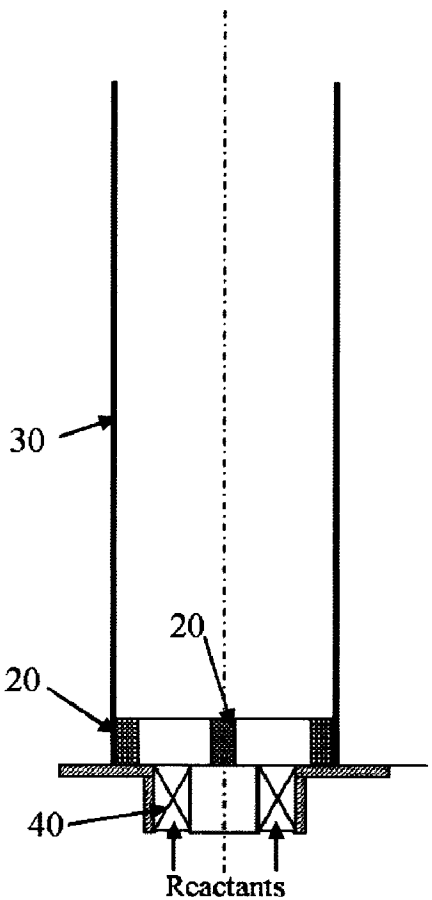
Figure 9B:
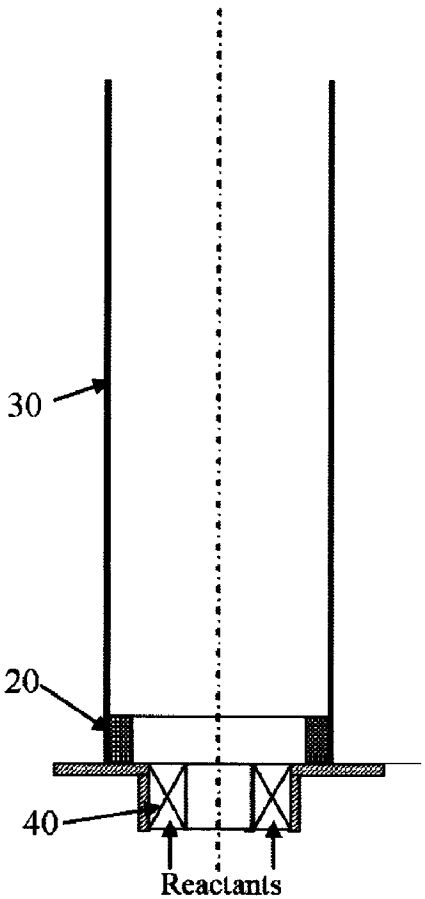
Figure 9A:
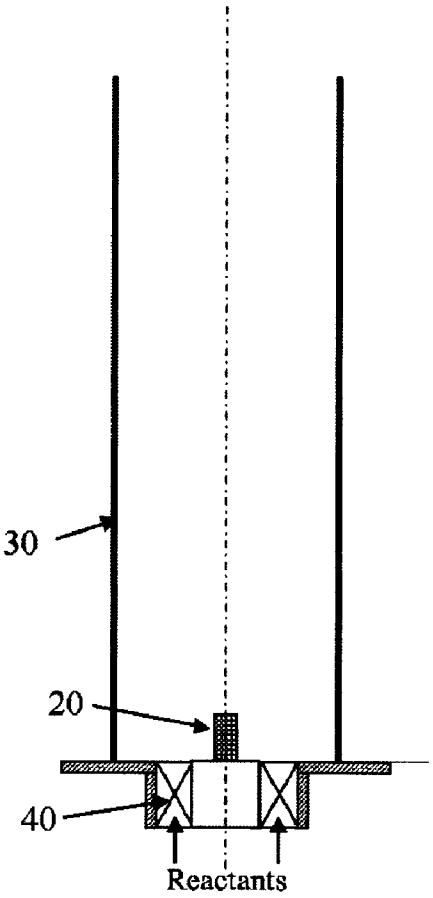

FIG. 9A is a partial cross-sectional view of one embodiment of the passive noise attenuation device positioned in a portion of a combustion chamber, showing an exemplary configuration A1 in which Z=0.

FIG. 9B is a partial cross-sectional view of one embodiment of the passive noise attenuation device positioned in a portion of a combustion chamber, showing an exemplary configuration A2 in which Z=0.

FIG. 9C is a partial cross-sectional view of one embodiment of the passive noise attenuation device positioned in a portion of a combustion chamber, showing an exemplary configuration A3 in which Z=0.

FIGS. 10A-10D are graphs showing the variation in dB levels for various thicknesses and configurations of at least one porous inert media, according to one embodiments exemplified in FIGS. 9A-9C (Φ=0.85).

FIGS. 11A-11D are graphs showing the variation in dB levels for various thicknesses and configurations of at least one porous inert media, according to one embodiments exemplified in FIGS. 9A-9C (Φ=0.85).

DETAILED DESCRIPTION OF THE INVENTION

The present invention can be understood more readily by reference to the following detailed description, examples, drawing, and claims, and their previous and following description. However, before the present devices, systems, and/or methods are disclosed and described, it is to be understood that this invention is not limited to the specific devices, systems, and/or methods disclosed unless otherwise specified, as such can, of course, vary. It is also to be understood that the terminology used herein is for the purpose of describing particular aspects only and is not intended to be limiting.

The following description of the invention is provided as an enabling teaching of the invention in its best, currently known embodiment. To this end, those skilled in the relevant art will recognize and appreciate that many changes can be made to the various aspects of the invention described herein, while still obtaining the beneficial results of the present invention. It will also be apparent that some of the desired benefits of the present invention can be obtained by selecting some of the features of the present invention without utilizing other features. Accordingly, those who work in the art will recognize that many modifications and adaptations to the present invention are possible and can even be desirable in certain circumstances and are a part of the present invention. Thus, the following description is provided as illustrative of the principles of the present invention and not in limitation thereof.

As used throughout, the singular forms "a," "an" and "the" include plural referents unless the context clearly dictates otherwise. Thus, for example, reference to "a porous structure" can include two or more such structures unless the context indicates otherwise.

Ranges can be expressed herein as from "about" one particular value, and/or to "about" another particular value. When such a range is expressed, another aspect includes from the one particular value and/or to the other particular value. Similarly, when values are expressed as approximations, by use of the antecedent "about," it will be understood that the particular value forms another aspect. It will be further understood that the endpoints of each of the ranges are significant both in relation to the other endpoint, and independently of the other endpoint.

As used herein, the terms "optional" or "optionally" mean that the subsequently described event or circumstance may or may not occur, and that the description includes instances where said event or circumstance occurs and instances where it does not.

The invention relates to a passive noise attenuation device 10 to suppress combustion noise in a conventional combustion system 25 that comprises a combustion chamber 30 and an injector assembly 32. A conventional combustion system can be, for example and without limitation, a gas turbine. In one aspect, the combustion system can have a reaction zone 34 in which a combustible material is burned, which creates combustion noise.

In one aspect, the passive noise attenuation device 10 can comprise at least one reticulated open-cell porous inert medium 20 that is configured as a passive control device to mitigate combustion noise and instability problems in combustion systems such as, for example and without limitation, turbine engines. In this aspect, the at least one porous inert medium can be placed downstream of the reaction zone of the combustion system and can dissipate noise and/or instability generated upstream in the combustion system. In another aspect of the passive noise attenuation device, the at least one porous inert medium 20 can be placed in the reaction zone 34 of the combustion system 25 and the vortex shedding mechanism of combustion noise and/or instability can be curtailed at its source. In this aspect, the at least one porous inert medium can constrain recirculation and/or high turbulence intensity regions in the reaction zone.

One aspect of the at least one porous inert medium can limit and/or disintegrate vortical structures in the flame in order to produce a more homogeneous flow field to facilitate distributed reaction zones. In another aspect of the passive noise attenuation device 10, combustion sustained within the at least one porous medium 20 can also provide the ignition energy needed to stabilize a flame of the combustion system 25.

In one aspect, the at least one porous inert medium ("PIM") of the passive noise attenuation device 10 can be reticulated open-cell foam coated in silicon carbide (SiC), lanthanum aluminate ($LaAlO_3$), hafnium carbide (HfC), or the like. In another aspect, the at least one PIM can be reticulated open-cell foam coated in a combination of the above components, or a combination of other components. In another aspect, the at least one PIM can be substantially disk-shaped or substantially ring-shaped, though other shapes such as substantially oval are contemplated. It is also contemplated that the shape of the at least one PIM 20 can be varied to conform to or follow a shape of a combustion chamber 30 into which the at least one PIM can be placed, as will be described more fully below.

In another aspect, the at least one porous inert medium can have a predetermined thickness. In one aspect, the predetermined thickness of the at least one PIM can range from between about 0.1 inches to about 12 inches. In another aspect, the predetermined thickness can range from between about 0.25 inches to about 3 inches. In still another aspect, the predetermined thickness can range from between about 0.5 inches to about 2 inches; however it is contemplated that the thickness can be varied depending upon the application. In another aspect, the at least one PIM 20 can be provided in sections having a thickness less than a desired thickness and can be stacked together to achieve the desired thickness.

In a further aspect, the at least one PIM can have a predetermined porosity. In one aspect, the predetermined porosity of the at least one PIM can range from between about 0.1 pores per inch ("ppi") to about 1,000 ppi. In another aspect, the predetermined porosity can range from between about 1.0 ppi to about 100 ppi. In still another aspect, the predetermined porosity can range from between about 9 ppi to about 10 ppi; however it is contemplated that the porosity can vary depending upon the application.

In one aspect, the at least one porous inert medium 20 can be placed in a combustion chamber 30 of a combustion system 25. In another aspect, the at least one PIM can be positioned downstream of the combustion chamber such that any noise and/or instability generated in the reaction zone 34 and/or the upstream combustion zone can at least be partially dissipated by the at least one PIM. In another aspect, the at least one PIM 20 can be placed in the reaction zone of the combustion chamber.

In one aspect, the at least one PIM can be positioned in the combustion chamber 30 of the combustion system such that a longitudinal axis of the at least one PIM can be substantially co-axially aligned with a longitudinal axis of the combustion chamber. In another aspect, however, it is contemplated that the at least one PIM 20 can be positioned in the combustion chamber of the combustion system 25 such that the longitudinal axis of the at least one PIM is not substantially co-axially aligned with respect to the longitudinal axis of the combustion chamber 30.

In another aspect, the at least one PIM can be positioned at a predetermined distance "Z" away from the combustion chamber inlet 36. In one aspect, the predetermined distance from the at least one porous medium to the combustion chamber inlet can be in the range from between about 0.0 inches to about 100 inches. In another aspect, the predetermined distance can range from between about 1.0 inch to about 30 inches. In still another aspect, the predetermined distance can range from between about 10 inches to about 12 inches; however it is contemplated that the distance from the at least one PIM 20 to the combustion chamber inlet 36 can vary depending upon the application. It is also contemplated that the distance Z from the at least one PIM to the combustion chamber inlet can be varied based on conditions within the combustion system 25. As can be appreciated, when the predetermined distance from the at least one PIM to the combustion chamber inlet 36 is zero inches, the at least one PIM 20 is positioned within the reaction zone 34.

In still another aspect, the at least one PIM can comprise a plurality of porous inert media. In this aspect, the plurality of porous inert media can be similarly shaped or they can be differently shaped. For example, and without limitation, a first PIM of the plurality of porous inert media can be substantially circular in shape and a second PIM 20 of the plurality of porous inert media can be substantially ring-shaped. In this aspect, it is contemplated that the plurality of porous inert media can be configured to cooperate with each other to improve the noise attenuation of the device 10.

In another aspect, the at least one PIM comprises a plurality of layers of porous inert media. For example, in one aspect, there can be three layers of porous inert media. In this aspect, the first, second, and third layers of porous inert media can be in stacked relationship with the third layer having a top portion exposed to the atmosphere. In another aspect, the first and third layers can have the same density. In yet another aspect, the second layer can have a density higher than that of the first and third layers. In this aspect, the higher density of the second layer can help prevent flash back, where the flame propagates upstream of the combustion chamber 30.

EXPERIMENTAL

Figure 1:
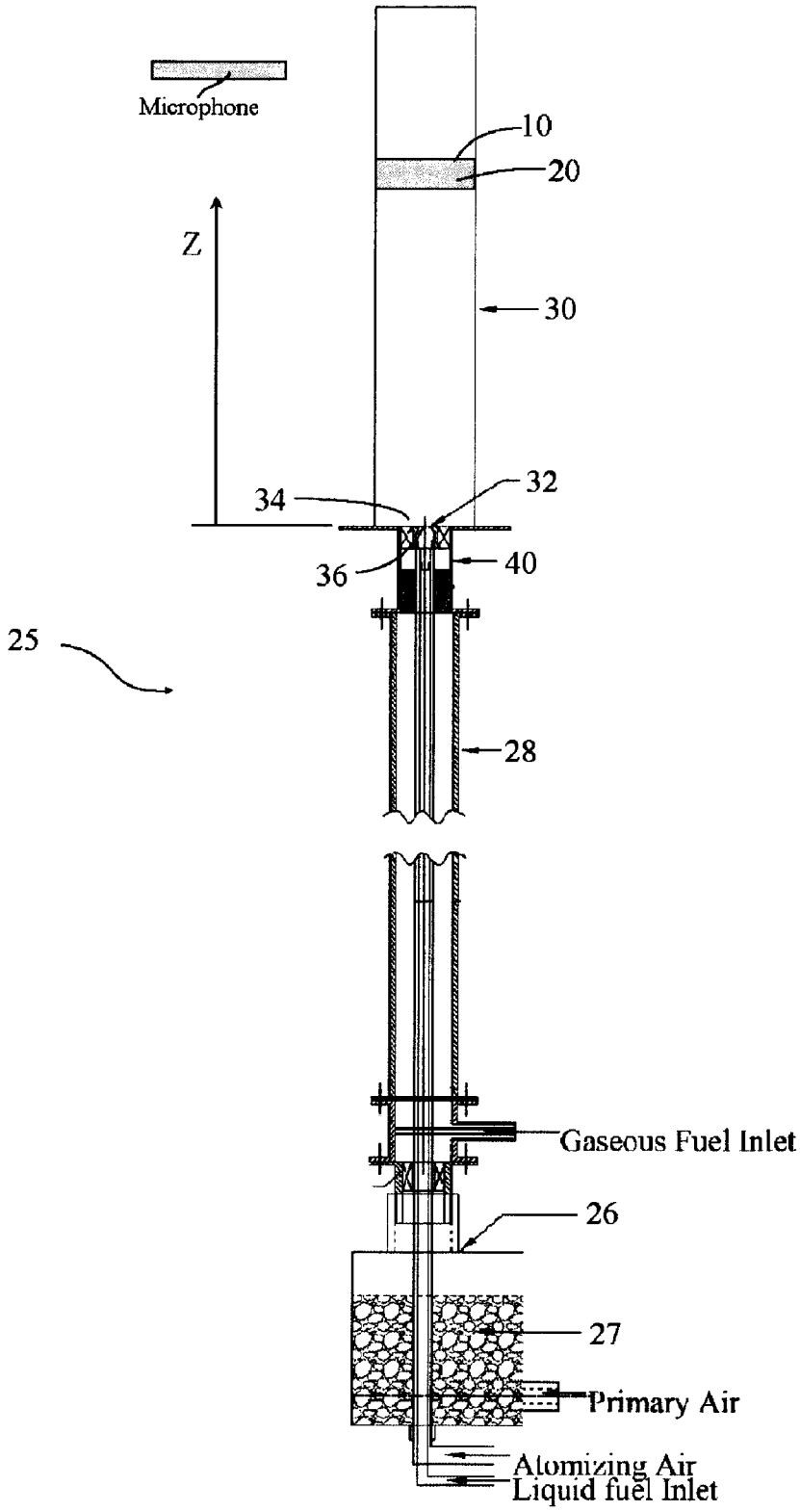
FIG. 1 is a schematic view of an experimental setup for testing one embodiment of a passive noise attenuation device.

In one example, and as exemplarily shown in FIG. 1, a swirl-stabilized combustion system 25 was developed to test the various aspects of passive noise attenuation device 10. Although it is contemplated that the conventional combustion system can operate on gaseous or liquid fuels, the initial experiments were conducted using gaseous methane.

Extensive cold flow experiments were conducted to minimize background noise, to select a micro-phone based sound measurement system, to determine microphone location with respect to the combustion system, to test a Labview based data acquisition system, and to develop data analysis procedures using fast Fourier transform techniques. The assembly configured to position the porous structure within the combustion system 25 was tested in cold flow experiments, which also ascertained the viability of the primary aspect in suppressing the noise.

In one embodiment, combustion experiments were performed with the at least one PIM 20 located downstream of the flame of the combustion system. For different equivalence ratios, sound measurements were obtained by varying the distance z between the combustion chamber inlet 36 and the porous inert medium, the relative thickness of the porous inert medium, and the relative pore size of the porous inert medium. These experiments revealed a significant reduction in combustion noise by the use of the PIM.

A portion of the experiments were conducted at flame temperature of about 1,400° C. (or equivalence ratio ($\Phi$) of 0.65) using SiC coated foam. Selected experiments were repeated at flame temperature of about 1,800° C. (or $\Phi$=0.85) using $LaAlO_3$ coated foam. Increase in temperature increased the total noise level, and, as will be discussed, the porous inert media of the passive noise attenuation device 10 were even more effective in reducing the noise levels. Within the range of the experiments, the PIM 20 distance from the combustion chamber inlet 36, PIM thickness, and PIM pore size had relatively small effect on combustion noise.

Figure 2:
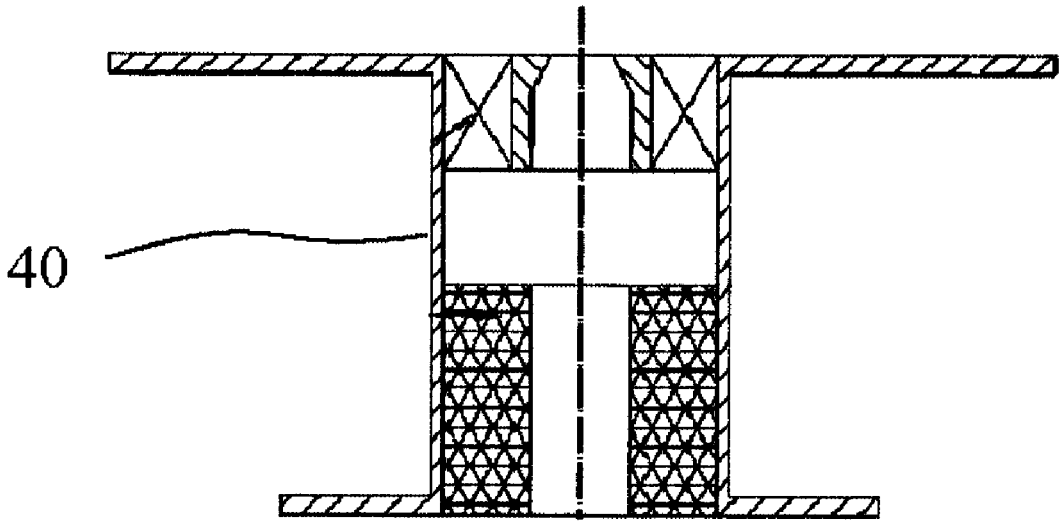
FIG. 2 is a cross-sectional view of a swirler of the experimental setup of FIG. 1.

The exemplary combustion system 25 test apparatus shown schematically in FIG. 1 comprises a combustion chamber 30 and an injector assembly 32. The primary air entered the combustion system through a plenum 26 filled with marbles 27 to breakdown the large vortical structures. The air passed into a mixing section, where the gaseous methane fuel source was introduced. This resulting fuel-air mixture entered the combustion chamber through a swirler 40, illustrated in FIG. 2. In one aspect, the swirler generated a center recirculation zone and a corner recirculation zone, which stabilized the flame by bringing hot products in continuous contact with the incoming reactants. In this aspect, and without limitation, the swirler had six vanes positioned at about 28° to the horizontal. The theoretical swirl number was 1.5, which assumes that the flow exited substantially tangentially from the swirler vanes. The experimental combustion chamber 30 was a 30.5 cm long quartz tube having an inner diameter of 8.1 cm. In one aspect, the experimental combustion system was back-side cooled by natural convection.

The combustion system 25 was designed to operate both on gaseous and liquid fuels. The liquid fuel line can be completely switched off or it can be used to create a pilot flame (with independent control of equivalence ratio) in case of gaseous combustion. In one aspect, this latter feature can be used in conjunction with the porous media in the recirculation zone to improve flame stability. The fuel injector was a conventional air-blast atomizer. In the experiments, the fuel injector was a Delavan Siphon type SNA nozzle. The injector was attached to separate concentric tube inlets to supply fuel and atomization air. The injector system ran through the plenum 26 and the mixing chamber 28. An O-ring within a sleeve was located at the bottom of the plenum to prevent any leakage.

The sound measurements were taken by a 0.5 inch diameter microphone probe (BK Type 4189) calibrated to provide a flat frequency response within 20 to 2,000 Hz range. The microphone probe was mounted 12 inches away from the combustion system 25 at the level of a combustor exit plane. The voltage output from the microphone was amplified ten times and then digitized by LabView based data acquisition system. Data acquired at 2,000 Hz was processed in real time to monitor frequency spectra. For selected test conditions, data taken at 5 second intervals was stored for post-processing.

The microphone probe provided a voltage output ("V") that is proportional to the pressure fluctuations ("P"). The proportionality constant (c=45 mV/Pa) was determined by calibrating the probe against a known standard. The measured data was used to obtain the mean square pressure fluctuation and then the total sound pressure in decibel. Extensive effort was spent to minimize the background noise and to position the microphone probe such that the sound frequency spectra could be accurately measured, without damaging the probe. These experiments also identified the sampling rate (2,000 Hz) and the number of samples (10,000) to ensure that frequency spectra were repeatable.

A fast Fourier analysis separated the signal into components at different frequencies. Thus, the frequency spectra curve provides the square amplitude of the pressure fluctuation (or $P_f^2$) at each frequency (f). For each frequency component, the sound pressure in decibel is found as:

$$dB_f = 10\log\left[\frac{P_f^2}{P_{ref}^2}\right]$$

Where $P_{ref}$ is taken as the reference pressure of $20\times10^{-6}$ Pa and $dB_f$ is the sound pressure in decibels.

The fast Fourier analysis resulted in broadband noise containing sound energy distributed continuously over the frequency range (0-1,000 Hz). These distributions were converted into one-third octave bands since each band pertained to the same auditory significance. The sound pressure was also computed in terms of the A-weighted decibel or dBA.

Figure 3:
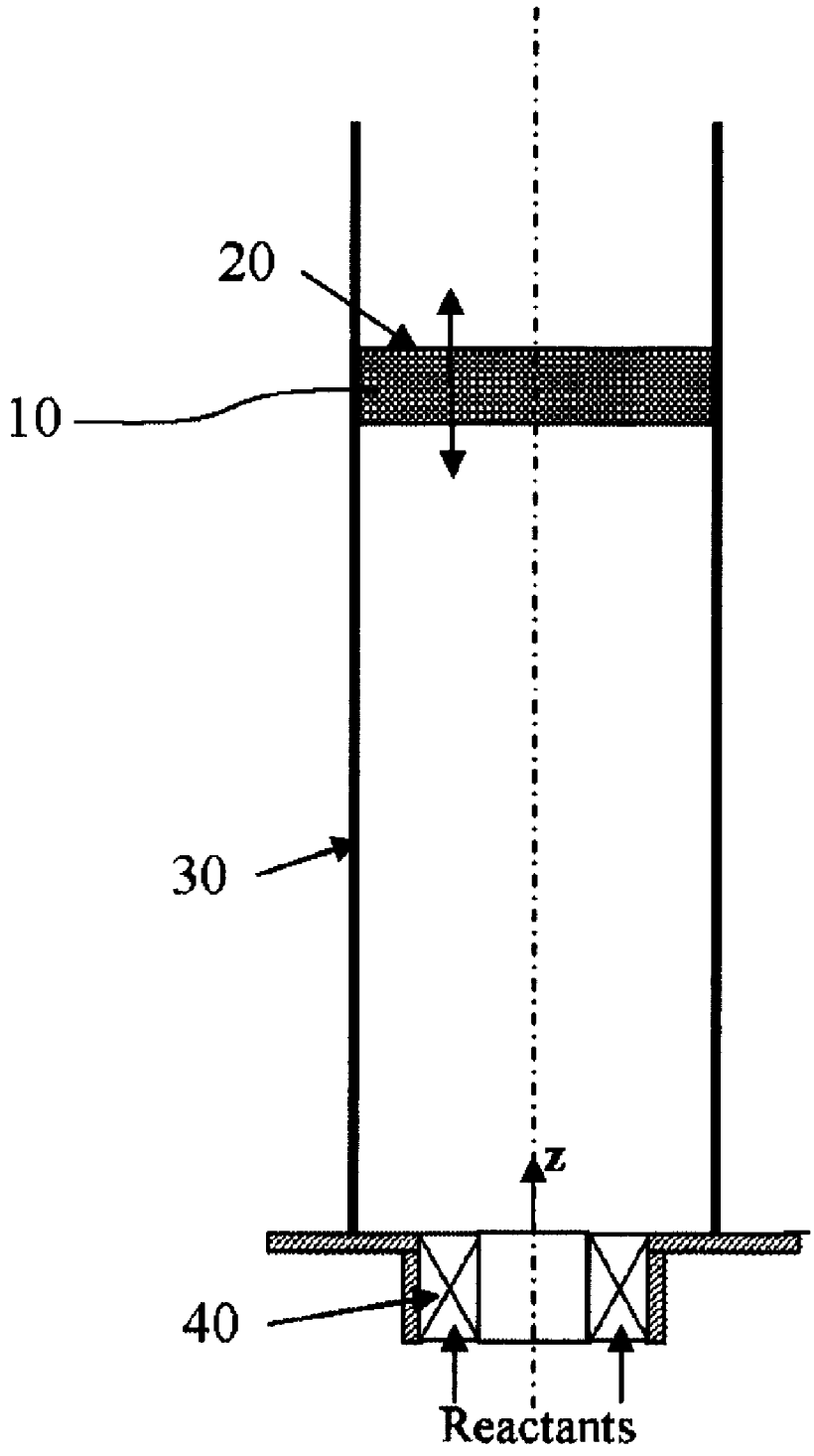
FIG. 3 is a partial cross-sectional view showing a porous inert medium disposed therein a combustion chamber at a distance Z from a combustion chamber inlet and downstream of the reaction zone.
Figure 4A:
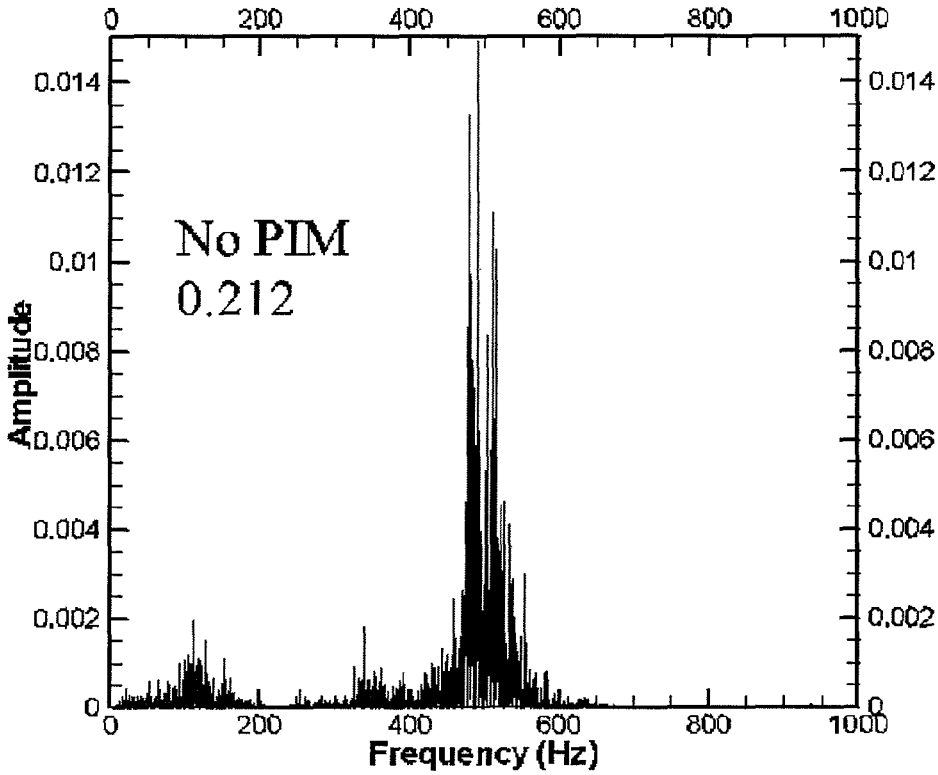
FIGS. 4A-4F show graphical data showing frequency spectra with no porous inert media and with a porous inert media at various distances Z from the combustion chamber inlet, according to one aspect (airflow rate Q=350 slpm and Φ=0.65; with and without a 1" thick porous inert media (SiC) of 10 ppi).
Figure 4B:
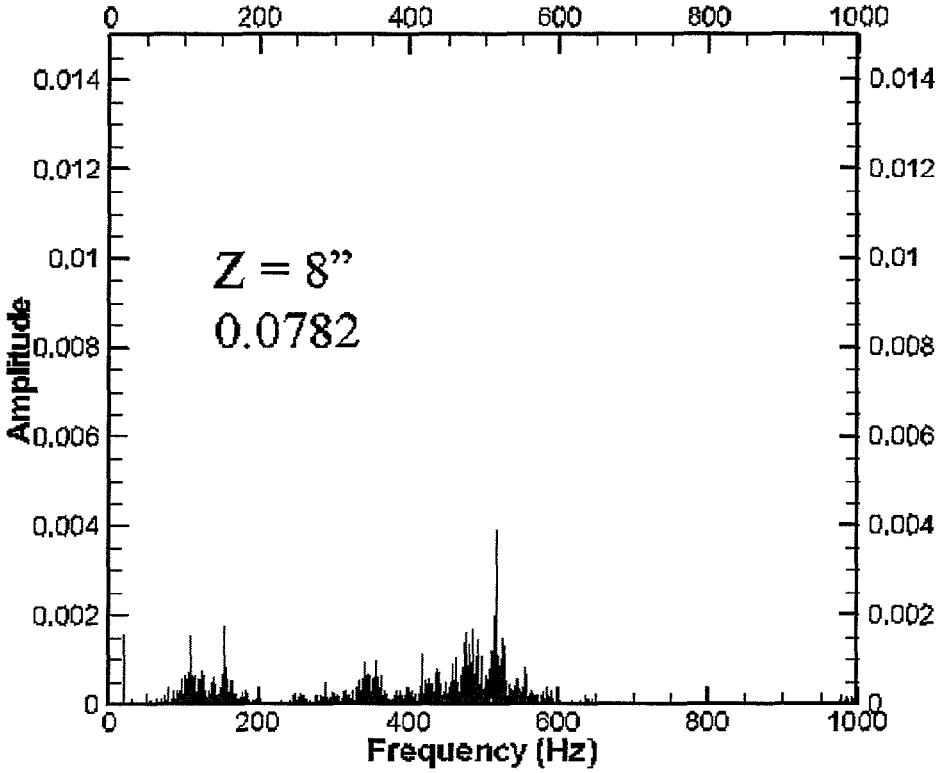
Figure 4C:
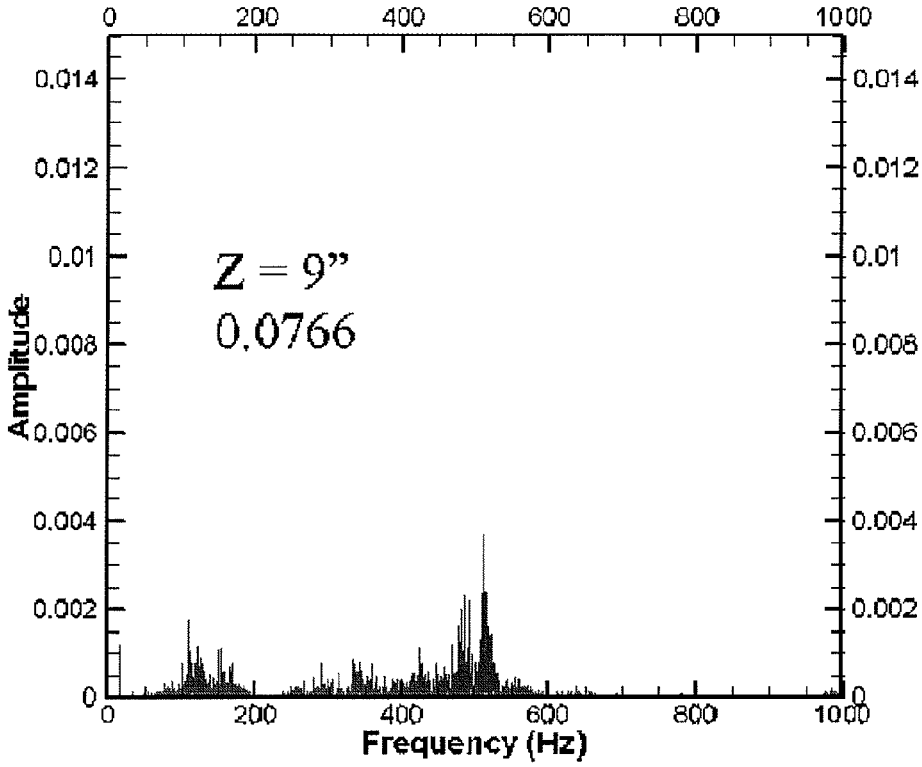
Figure 4D:
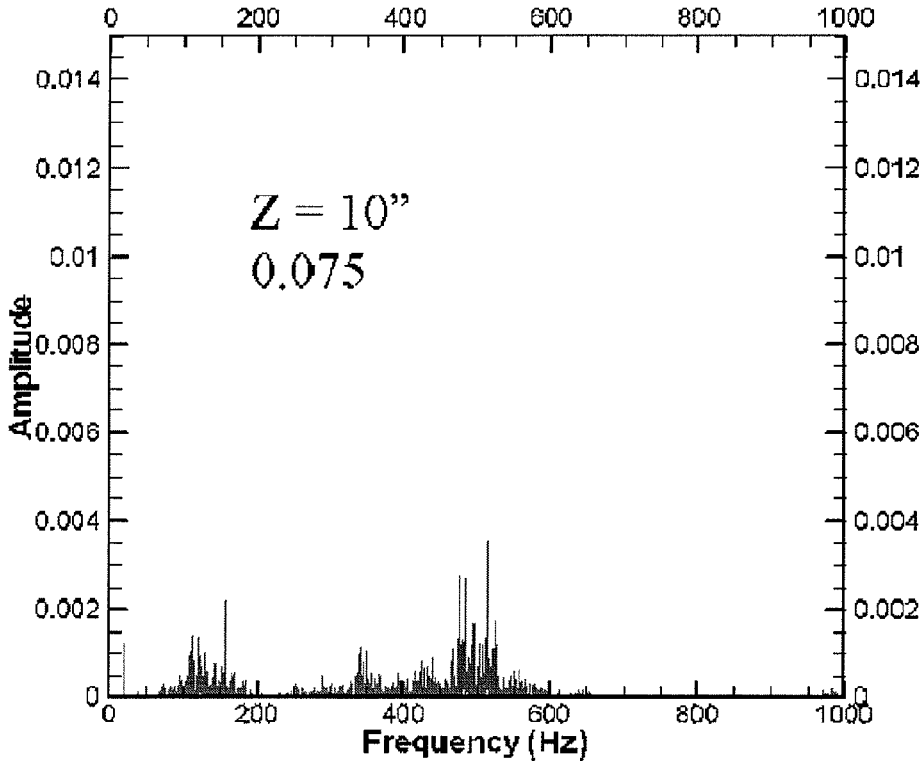
Figure 4E:
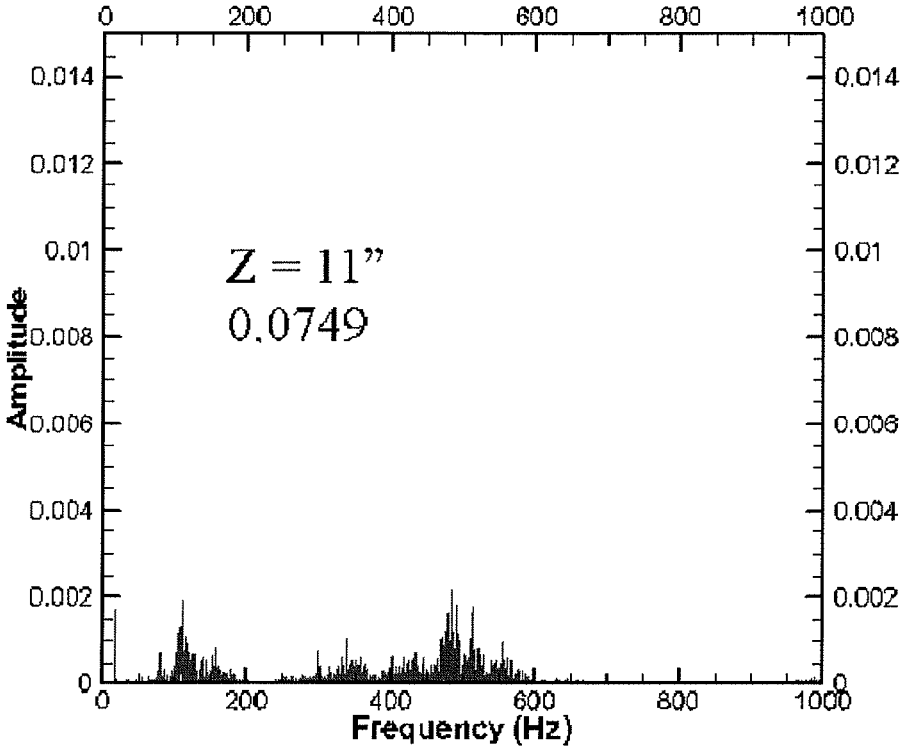
Figure 4F:
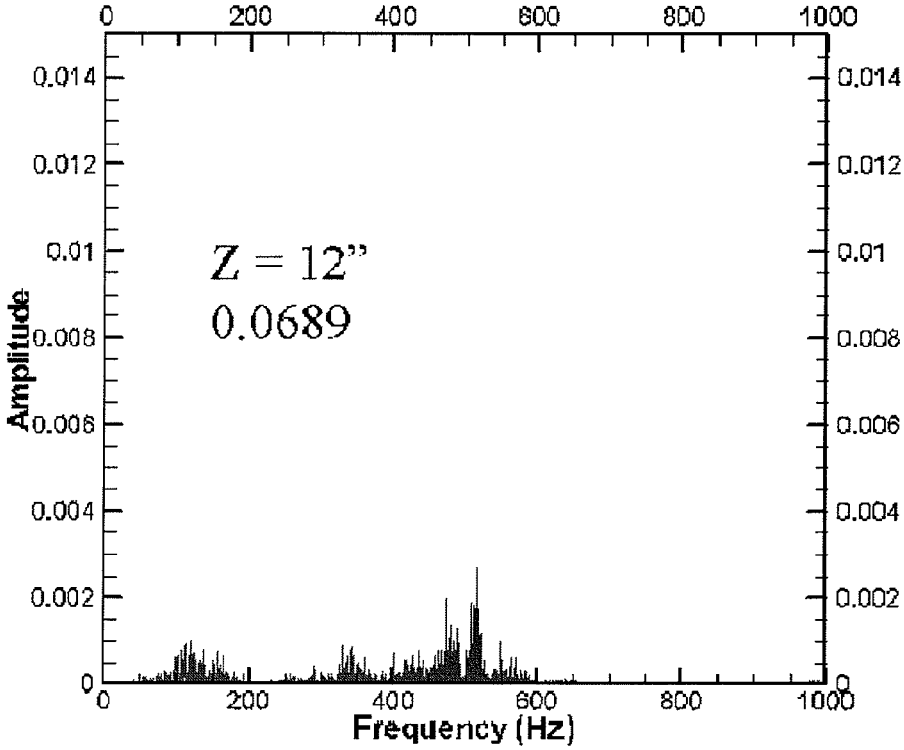

FIG. 3 schematically depicts the set-up of one exemplary embodiment of the experiment set up for the passive noise attenuation device 10. The PIM was positioned transversely in the combustion chamber 30 downstream at a distance Z from the reaction zone 34. Initially, experiments using SiC coated foam as the porous medium were conducted for equivalence ratios (ϕ) of 0.60 and 0.65, although results are presented only for equivalence ratio of 0.65 and airflow rate ("Q") of 350 standard liters per minute ("slpm"). Without the PIM 20, the flame within the combustion chamber appeared blue and was confined to about one-third the length of the combustion chamber 30. The visual flame structure was not affected by the porous medium located at the combustor exit plane. The PIM emitted intense radiation marked by the orange glow because of the heating by combustion products. Thus, heating of combustion system and turbine components by radiation from the PIM were considered when implementing this exemplary embodiment for noise reduction.

FIGS. 4A-4F show sound frequency spectra for the experimental passive noise attenuation device 10 operating without a PIM (FIG. 4A) and with a PIM 20 comprised of SiC coated foam having a thickness of about one inch and a porosity of about 10 ppi (FIGS. 4B-4F). The sound amplitude in FIGS. 4A-4F is given in arbitrary units. The illustrated test results show two main frequency bands without the PIM (FIG. 4A); one centered around 125 Hz and the other centered at 500 Hz. In both bands, the sound intensity was dispersed and the high frequency band contained much of the power. The noise originated mainly by the heat release in the flame, since the sound intensity measured in the cold flow experiments (not shown here) was smaller by nearly two orders of magnitudes. The sound pressure amplitude illustrated in FIG. 4A-4F was integrated to obtain a relative measure of the total sound power, in arbitrary units. The total sound power for combustion without the porous medium was 0.212.

FIGS. 4B-4F present sound frequency spectra for the experimental passive noise attenuation device 10 operated with a 1 inch thick PIM 20 placed at various axial distances from the combustion chamber inlet 36 plane, where Z represents the axial distance. Thus, Z=12" means the PIM was placed about 12 inches from the combustion chamber inlet plane. As can be seen, the results show a significant reduction in the noise intensity for the frequency band centered at 500 Hz at each of the various Z distances. The noise intensity in the 125 Hz band also decreased, although the reduction around this low frequency band is smaller. Also, as indicated by the total sound power displayed on each graph (for example, total sound power when Z=8" is 0.0782), the total sound power is nearly independent of the location of the porous medium in the combustion chamber 30. FIGS. 5 and 8 illustrate the reduction in the level of sound with the use of a PIM 20, and the similarity between the reduction in the level of sound when the NM is positioned 4 inches or 12 inches from the combustion chamber inlet 36 for Φ=0.65 (FIG. 5) and Φ=0.80 (FIG. 8).

Measurements with porous inert media of different pore size and thickness produced similar results; i.e., the 550 Hz band was suppressed and the total sound power decreased in the presence of a porous medium, regardless of its axial position from the combustion chamber inlet. FIGS. 6A and 6B show the total sound power (in dB) versus axial location (Z) for 1 inch (FIG. 6A) and 3 inch (FIG. 6B) thick porous structures having a porosity of 10 ppi and 20 ppi. Five sets of 10,000 data points were taken at each test condition to compute the measurement uncertainties. As can be seen, the results show that the porous medium decreases the total sound power, and the level of reduction is about the same for 10 or 20 ppi structures of 1 inch or 3 inch thicknesses. Additionally, the results show that the total sound power is substantially independent of the thickness of the porous structure. Moreover, relatively small error bars indicate that the data are repeatable. Similar data is illustrated in FIGS. 7A and 7B, wherein FIG. 7A shows the total sound power (in dB) versus axial location (Z) for a 20 ppi porous structure and FIG. 7A shows the total sound power versus axial location for a 10 ppi porous structure.

Combustion experiments were also performed to determine the effectiveness of a second embodiment in reducing noise production. As illustrated in FIGS. 9A-9C, three configurations of the passive noise attenuation device 10 were tested to modify the flame structure of the combustion system 25: (1) configuration A1, comprising a substantially disk-shaped PIM 20 substantially co-axially aligned with the longitudinal axis of the combustion chamber 30 to alter the flow field of a center flow recirculation region of the combustion chamber; (2) configuration A2, with a substantially circular ring-shaped PIM used to affect the flow in the corner and near wall region of the combustion chamber; and (3) configuration A3, using a combination of a disk-shaped PIM placed in the center of the combustion chamber 30 and a ring-shaped PIM placed in the lower corner of the combustion chamber.

The porous inert media 20 was capable of sustaining the high flame temperatures encountered within the reaction zone 34. In this experiment, a PIM comprising HfC/SiC coated foam such as that developed and supplied by Ultramet Corporation was used. In one aspect, the at least one PIM was secured in the combustion chamber 30 by securing it to a combustor face plate using, for example and without limitation, molybdenum wire. Although experiments were conducted for a range of flame temperatures, results are presented only for Φ=0.85, which correlates to adiabatic flame temperature of about 1,800° C.

Figure 10A:
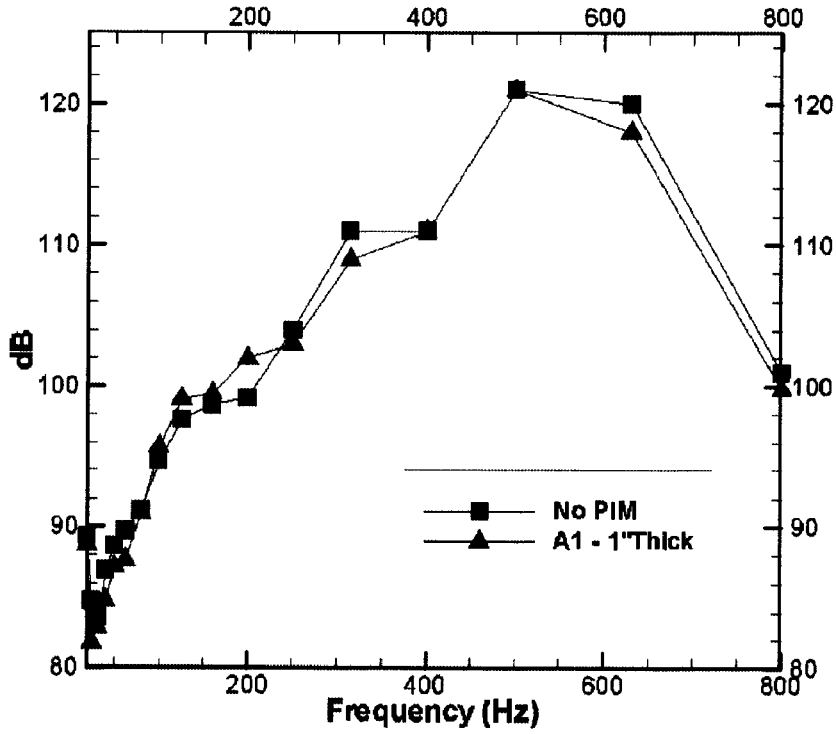
Figure 10B:
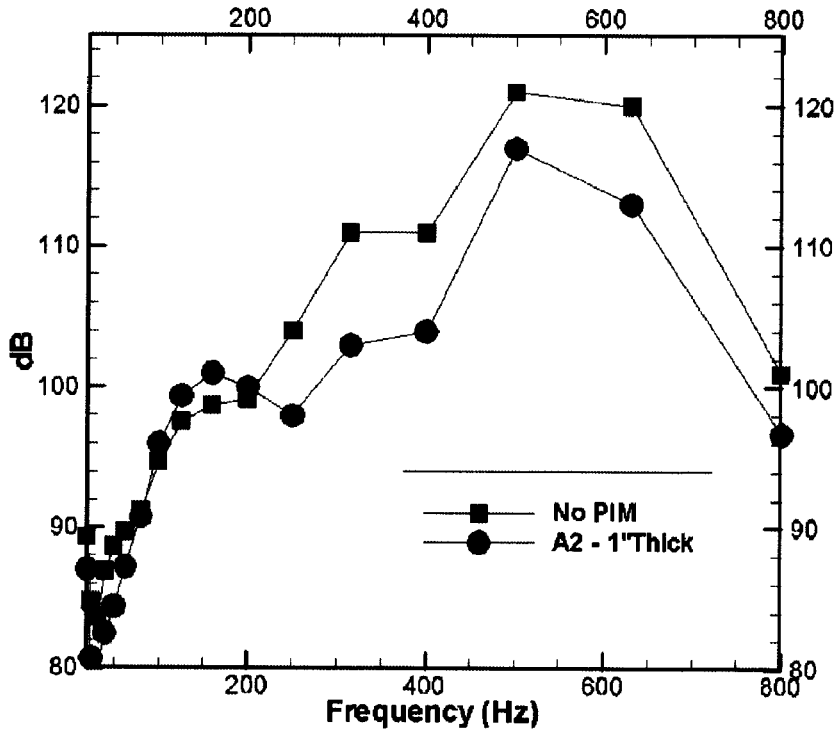
Figure 10C:
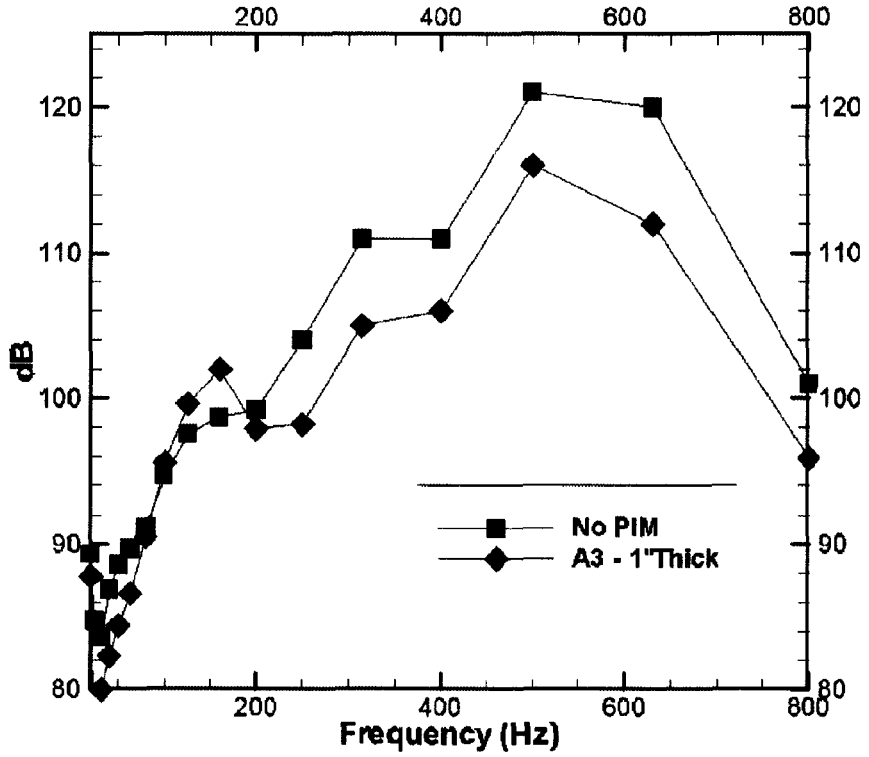
Figure 10D:
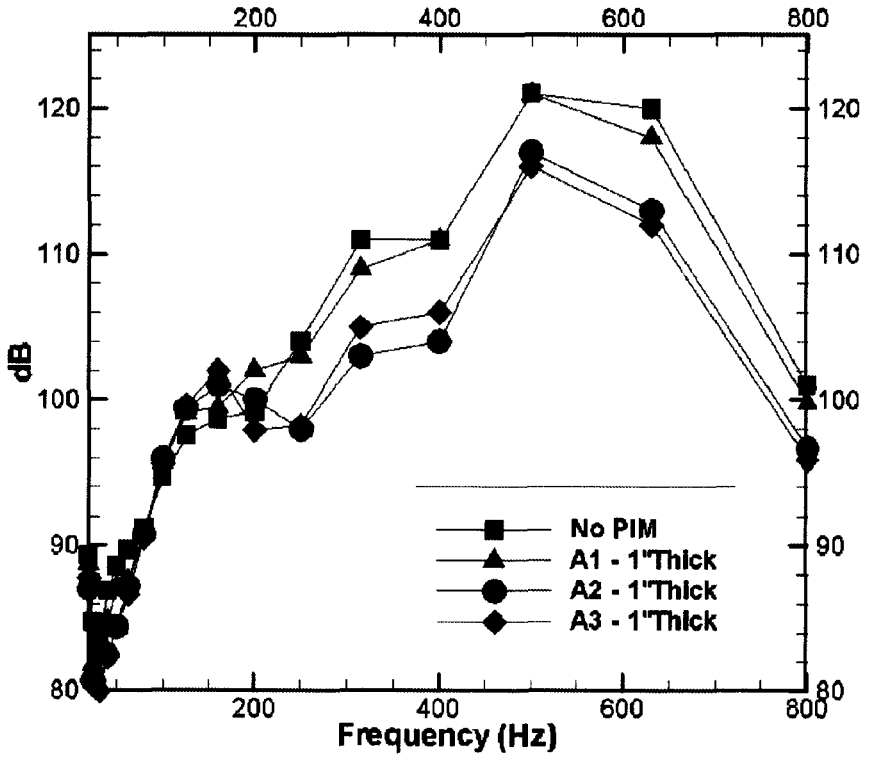

As illustrated in FIG. 10A, the sound level was not substantially affected by the center disk of Configuration A1. However, FIG. 10B shows that Configuration A2 was effective in reducing the noise level over a range of frequency bands when the at least one PIM 20 was shaped and positioned as a corner ring. FIGS. 10C and 10D show that configurations A2 and A3 were equally effective in reducing the noise level over a range of frequency bands. Results of FIGS. 10A-10C are summarized in Table 1 in terms of the total sound power. The combustion system 25 generated 124 dB without the PIM. The noise level was 123 dB with a 1 inch thick center piece (Configuration A1), 119 dB with a 1 inch thick corner piece (Configuration A2), and 119 dB with both center disc and corner ring (Configuration A3).

TABLE 1

Total dB and dBA for Embodiment II configurations.

| | No PIM00 | A1 - 1" Thick | A2 - 1" Thick | A3 - 1" Thick |
|---|---|---|---|---|
| dB (Total) | 124 | 123 | 119 | 119 |
| dBA | 121 | 120 | 116 | 116 |

Figure 11A:
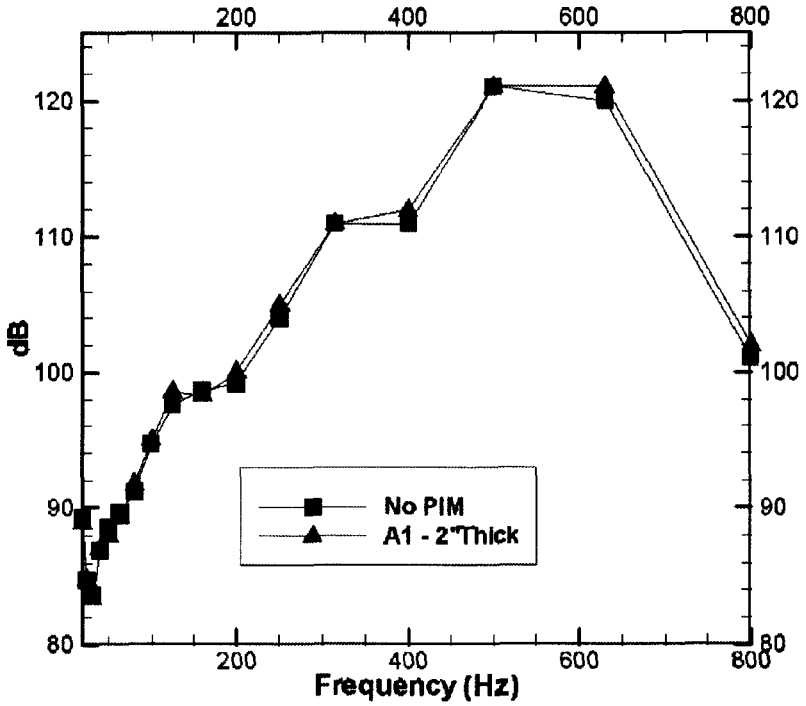
Figure 11B:
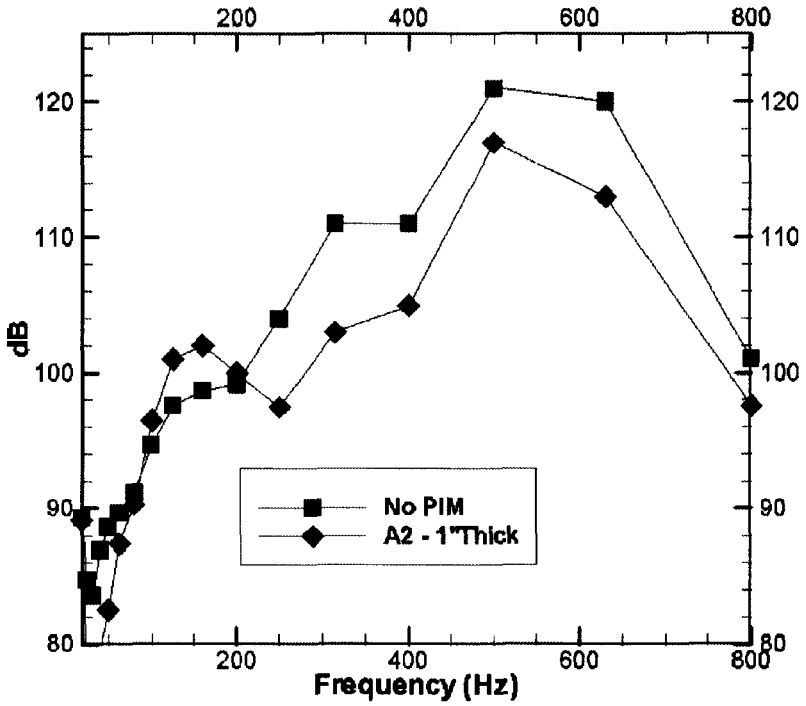
Figure 11C:
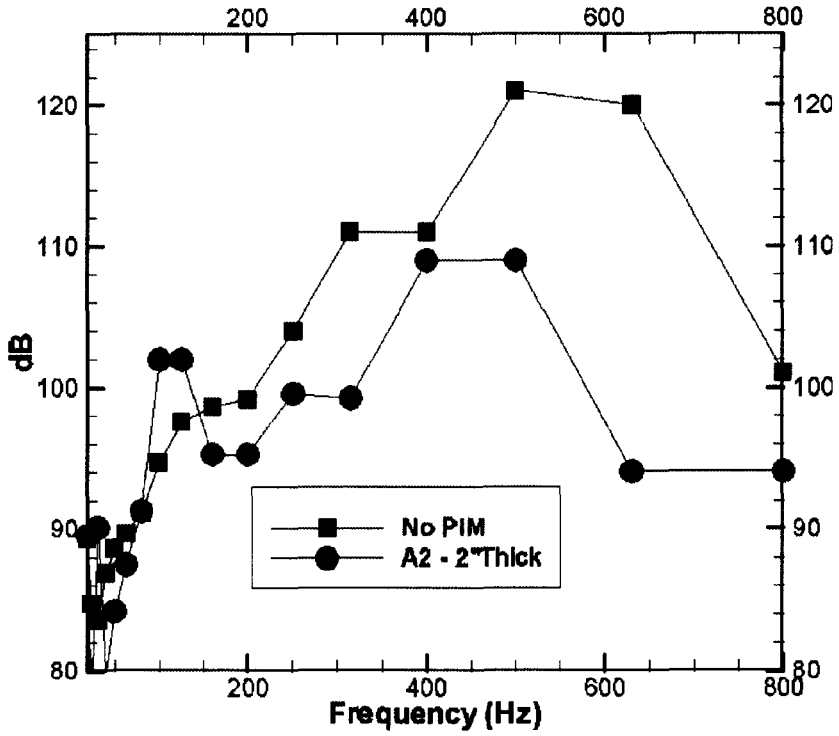
Figure 11D:
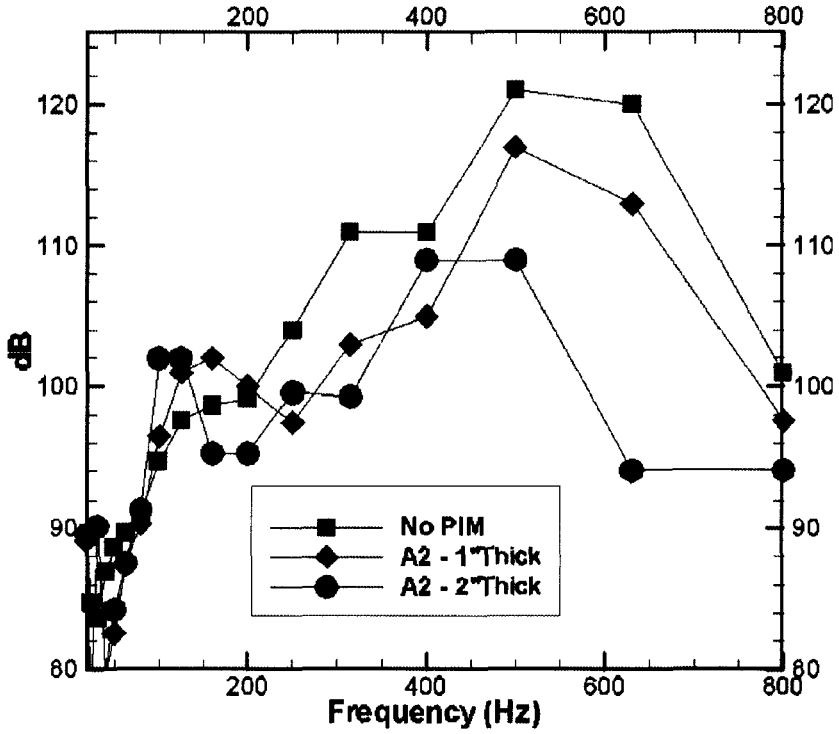

A final set of experiments were performed using at least one PIM of (HfC/SiC) having a thickness of 1 inch and a porosity of 20 ppi. In this experiment, Configuration A2 produced blue flames with reactions occurring both in the free flame in the central region and in flamelets on the surface of the PIM. As illustrated in FIGS. 11A-11D, noise reduction with a 2 inch thick corner piece porous media was significantly greater than that for the 1 inch thick corner piece porous media. Results of FIGS. 11A-11C are summarized in Table 2 in terms of the total sound power. In this experiment, the combustion system generated 124 dB without the PIM, and the noise level was the same with a 2 inch thick center piece porous media (Configuration A1). However, the 1 inch thick corner piece porous media reduced the noise level to 119 dB and the 2 inch thick corner piece media reduced the noise level to 113 dB, a noise reduction of 11 dB.

TABLE 2

Total dB and dBA for Embodiment II configurations

| | No PIM | A1 - 2" Thick | A2 - 1" Thick | A2 - 2" Thick |
|---|---|---|---|---|
| dB (Total) | 124 | 124 | 119 | 113 |
| dBA | 121 | 121 | 116 | 109 |

Although several embodiments of the invention have been disclosed in the foregoing specification, it is understood by those skilled in the art that many modifications and other embodiments of the invention will come to mind to which the invention pertains, having the benefit of the teaching presented in the foregoing description and associated drawings. It is thus understood that the invention is not limited to the specific embodiments disclosed hereinabove, and that many modifications and other embodiments are intended to be included within the scope of the appended claims. Moreover, although specific terms are employed herein, as well as in the claims which follow, they are used only in a generic and descriptive sense, and not for the purposes of limiting the described invention, nor the claims which follow.

We claim:

1. A noise attenuation device to suppress combustion noise in a combustion system comprising:

a main combustion chamber, a main combustion chamber inlet and a reaction zone, the noise attenuation device comprising:

at least one porous inert media having a porosity and material composition configured for suppressing combustion noise vibrations and positioned in the main combustion chamber downstream of the reaction zone, wherein a leading upstream inner edge of the porous inert media is directly exposed to the reaction zone.

2. The noise attenuation device of claim 1, wherein the at least one porous inert media is a reticulated open-cell porous structure.

3. The noise attenuation device of claim 2, wherein the at least one porous inert media is silicon carbide coated foam.

4. The noise attenuation device of claim 2, wherein the at least one porous inert media is lanthanum aluminate coated foam.

5. The noise attenuation device of claim 1, wherein the at least one porous inert media comprises a plurality of porous inert media.

6. The noise attenuation device of claim 5, wherein at least one porous inert media of the plurality of porous inert media is substantially circular in shape, wherein at least one porous inert media of the plurality of porous inert media is substantially ring-shaped, and wherein at least one porous inert media of the plurality of porous inert media is positioned such that a longitudinal axis of the at least one porous inert media is substantially co-axially aligned with a longitudinal axis of the main combustion chamber.

7. The noise attenuation device of claim 1, wherein the at least one porous inert media is configured to limit vortical structures in a flame of the combustion system.

8. The noise attenuation device of claim 7, wherein combustion sustained within the at least one porous inert media stabilizes a flame of the combustion system.

9. The noise attenuation device of claim 1, wherein the at least one porous inert media is substantially circular in shape and positioned such that a longitudinal axis of the at least one porous inert media is substantially co-axially aligned with a longitudinal axis of the main combustion chamber.

10. The noise attenuation device of claim 1, wherein the at least one porous inert media is substantially ring-shaped and positioned such that a longitudinal axis of the at least one porous inert media is substantially co-axially aligned with a longitudinal axis of the main combustion chamber.

11. The noise attenuation device of claim 1, wherein the at least one porous inert media has a thickness in the range from about 0.1 inches to about 12 inches.

12. The noise attenuation device of claim 1, wherein the at least one porous inert media has a porosity in the range from about 0.1 pores per inch to about 1000 pores per inch.

13. The noise attenuation device of claim 1, wherein the at least one porous inert media is positioned a distance away from the combustion chamber inlet in the range from about 0.1 inches to about 100 inches.

14. The noise attenuation device of claim 1, wherein the combustion chamber inlet defines where fuel first enters the main combustion chamber, the reaction zone is adjacent the combustion chamber inlet and the porous inert media is positioned in a portion of the main combustion chamber positioned along an axis extending through the combustion chamber inlet and the reaction zone.

15. A noise attenuation system to suppress combustion noise comprising:

a combustion system comprising a combustion chamber, a combustion chamber inlet and a reaction zone positioned immediately adjacent to, and extending linearly from, the combustion chamber inlet; and at least one porous inert media having a porosity and material composition configured for suppressing combustion noise vibrations and positioned linearly along the reaction zone and wherein no surface intervenes between the reaction zone and a leading upstream inner edge of the porous inert media.

16. The noise attenuation system of claim 15, wherein the at least one porous inert media is a reticulated open-cell porous structure.

17. The noise attenuation system of claim 15, wherein the combustion system is a gas turbine.

* * * * *